United States Patent [19]

Reinschutz

[11] 4,125,341

[45] Nov. 14, 1978

[54] PAVING BLOCK

[76] Inventor: Hans Reinschutz, Geigersbergstrasse 2, 7500 Karlsruhe 41, Germany

[21] Appl. No.: 828,087

[22] Filed: Aug. 26, 1977

[30] Foreign Application Priority Data

Jan. 10, 1977 [DE] Fed. Rep. of Germany ... 7700509[U]

[51] Int. Cl.[2] ..... E01C 5/00

[52] U.S. Cl. ..... 404/41

[58] Field of Search ..... 404/41, 34, 42, 39, 404/40; 52/590, 596, 603

[56] References Cited

U.S. PATENT DOCUMENTS

| | | | |
|---|---|---|---|
| 470,377 | 3/1892 | Graham | 404/41 |
| 1,474,779 | 11/1923 | Kammer | 52/590 |
| 1,778,927 | 10/1930 | Wright | 404/41 |
| 3,494,266 | 2/1970 | Baumberger | 404/41 |
| 3,602,111 | 8/1971 | Clemente | 404/41 |

*Primary Examiner*—Nile C. Byers, Jr.

*Attorney, Agent, or Firm*—Craig & Antonelli

[57] ABSTRACT

An improved paving block is disclosed. The paving block is of the type which comprises at least four paving elements of equal height seated on a common foot and which has side walls that present convex and concave curvilinear generatrices. A part of the side walls of the block are formed with at least one flat surface so as to provide better stacking, easier laying down and improved mutual engagement of the blocks for enhanced load stability of the finished paving.

10 Claims, 3 Drawing Figures

PAVING BLOCK

BACKGROUND AND SUMMARY OF THE INVENTION

The invention relates to paving blocks of the type which comprise at least four paving elements of equal height which are seated on a common foot and present side walls that are convex and concave curvilinear generatrices. Such paving blocks may be formed of concrete. In a preferred embodiment of the invention the paving elements are circular-cylindrical in shape and the side walls of the block present convex and concave cylinder generatrices.

The paving block of the invention serves as paving for light and medium loads, and finds its application as a pavement for walkways and garden paths as well as for courtyards and driveways, where it is attractive both because of the rational way in which it can be laid down and because of the appearance of the finished paving.

Concrete paving blocks are known from German Gebrauchsmuster 7,318,305 and 7,440,074, which consist of four or six cylindrical elements of equal height, seated on a common foot. This foot alternatingly presents side walls with convex and concave curvature. In these paving blocks, however, there is much left to be desired as far as better stacking, easier laying down and mutual engagement of the blocks is concerned.

The problem to which the present invention is addressed is improvement of known paving blocks of the described type, and this problem is solved in that at least part of the side walls forms a flat surface, such as a flat rectangular surface. Such a surface offers advantages in manufacture and shipping as well as in the laying down of the pavement blocks and improves their mutual engagement, from which there results an enhanced load stability of the finished paving.

Advantageously, in one embodiment, concave cylinder generatrices join a flat rectangular surface on both sides, with an obtuse angle. This measure facilitates manufacture of the mold for a paving block formed with six circular-cylindrical paving elements.

According to another advantageous feature of certain embodiments, a paving block formed of four paving elements has small rectangular surfaces which join with both sides of a relatively larger, flat rectangular surface at an obtuse angle, each of said small surfaces, in turn, joining one of the concave or convex cylinder surfaces. In this way, manufacture of the mold for the 4-part paving block is facilitated.

These and other objects, features and advantages of the present invention will become more apparent from the following description when taken in connection with the accompanying drawings, which show, for purposes of illustration only, several embodiments in accordance with the present invention.

DETAILED DESCRIPTION OF THE DRAWINGS

Figure 1:
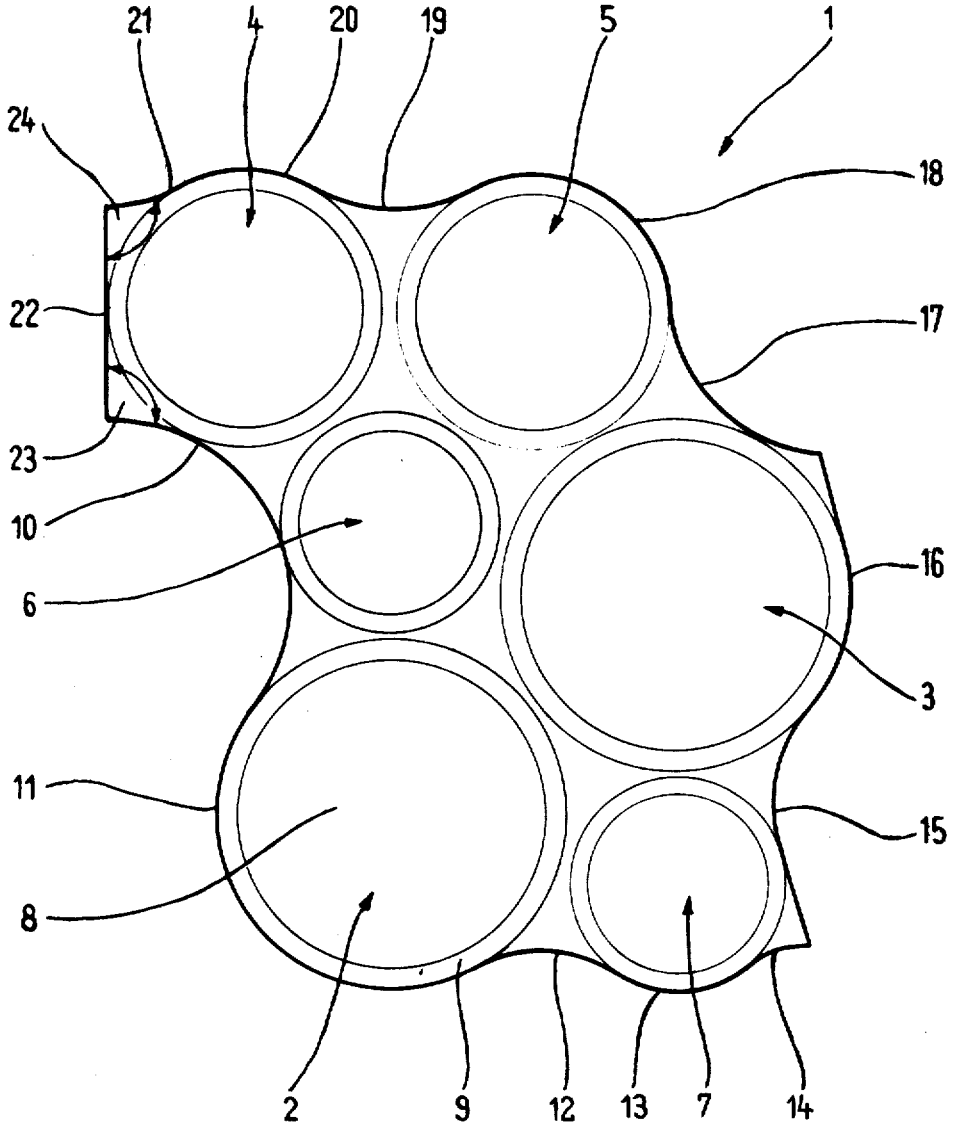
FIG. 1 shows a paving block formed with six circular-cylindrical paving elements, in about half their actual size, in top view.

In the embodiment of FIG. 1, a paving block 1, according to the invention, is formed with six circular-cylindrical paving elements 2, 3, 4, 5, 6 and 7 which present a common foot. Paving block 1 is manufactured as a single piece.

The six paving elements 2 through 7 lie closely against each other and are of the same height. They have three different diameters and are so combined in a closed group that the two paving elements 2 and 3 (large diameter) and the two elements 6 and 7 (small diameter) are disposed in a cross configuration with the two elements 2 and 3 in contact and between the two elements 6 and 7. The two paving elements 4 and 5 (medium diameter) are next to each other and each is in contact with element 6 (small diameter).

The six paving elements 2 through 7, as seen in outline, go smoothly with their outward side walls into the common foot which makes up the major part of the height of paving block 1. Elements 2 through 7 have circular-cylindrical cover surfaces 8 which present bevels 9 of equal width, for protection of the edges as well as for the sake of appearance.

The side walls of the foot of paving block 1 comprise preponderantly convex and concave cylinder generatrices 10 to 21, which join each other. However, part of the side walls form a flat rectangular surface 22 in the region of paving element 4. One side of the surface 22 is joined to concave cylinder generatrix 10 at an obtuse angle 23, and its opposite side is joined to the concave cylinder generatrix 21, also at an obtuse angle 24. As seen in FIG. 1, the plane of the flat surface 22 is parallel to the side walls and axes of the circular-cylindrical paving elements 2, 3, 4, 5, 6 and 7.

Figure 2:
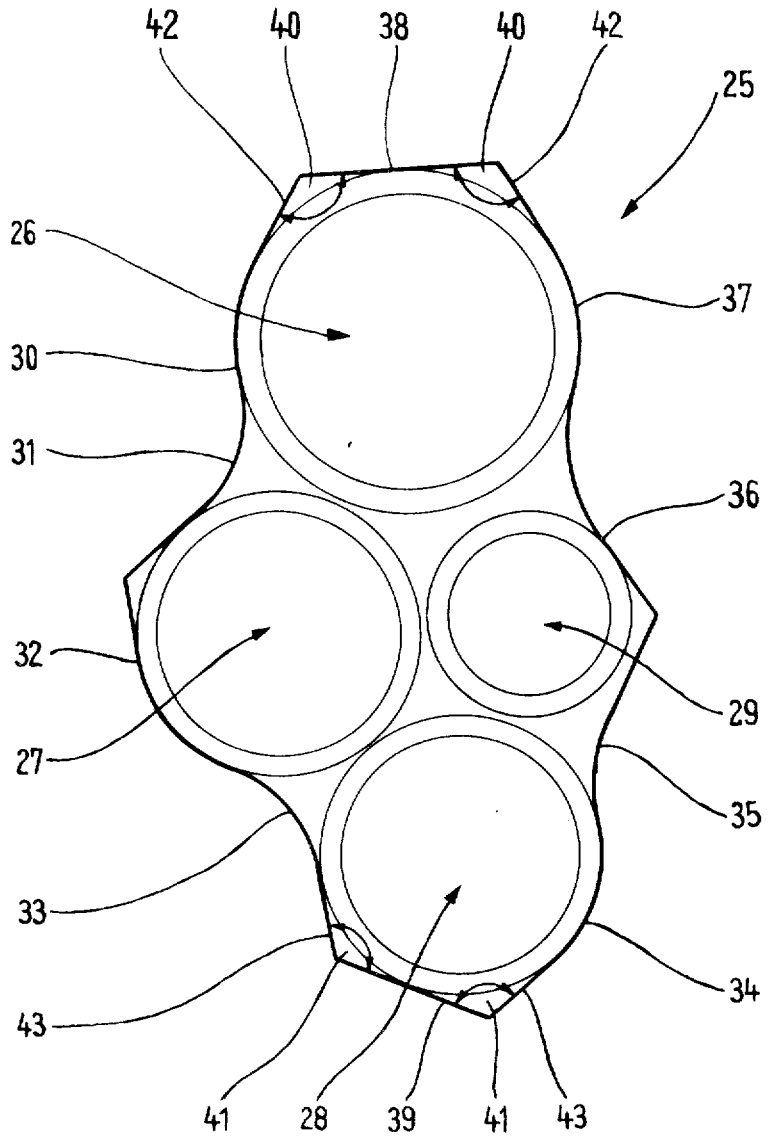
FIG. 2 shows a paving block formed with four circular-cylindrical paving elements, also in about half the actual size, in top view.

Paving block 25 which is illustrated in FIG. 2 corresponds to block 1 in structure, but it comprises only four paving elements 26 through 29 of three different diameters.

The side walls of the foot of paving block 25 also comprise preponderantly convex and concave cylinder generatrices 30 to 37 which join each other. However, two parts of the side walls are constituted respectively by a flat rectangular surface 38 or 39. The first rectangular surface 38 is applied to paving element 26 (large diameter) and the second rectangular surface 39 is applied to element 28 (medium diameter).

Small rectangular surfaces 42 and 43 join the two respective rectangular surfaces 38 and 39, with obtuse angles 40, 41, the said surfaces 42 and 43 going smoothly over into one of the concave (33) or convex (34, 30, 37) cylinder generatrices.

Figure 3:
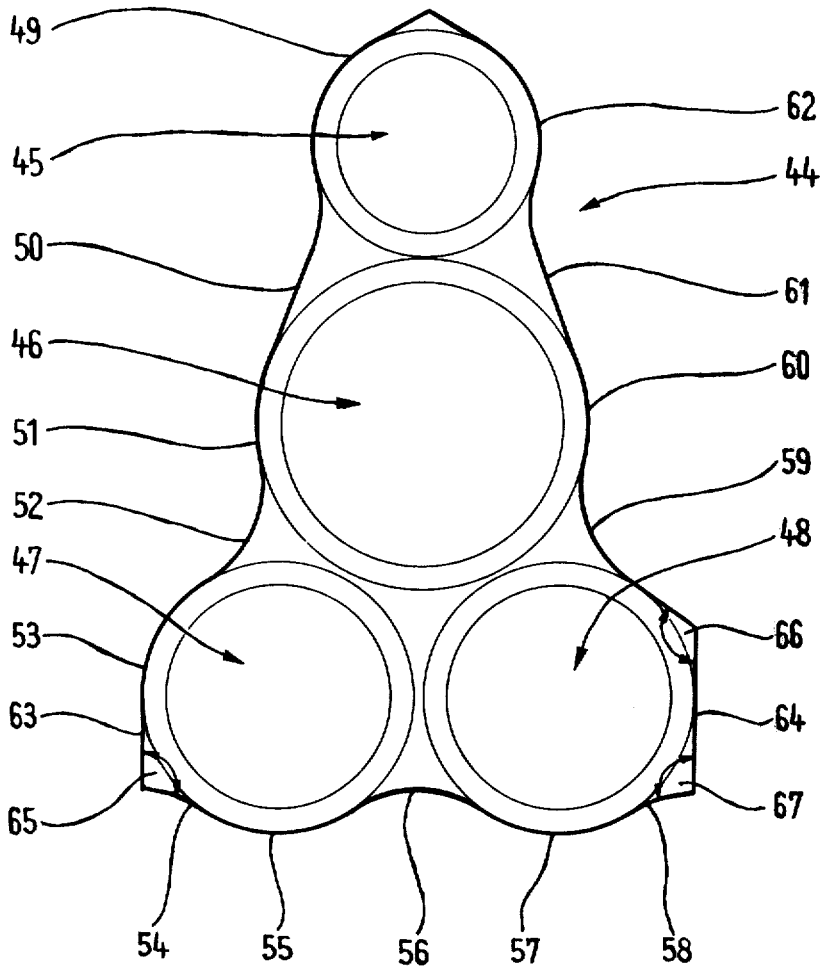
FIG. 3 is a top view of a paving block also containing four circular-cylindrical paving elements, in another embodiment, in half the actual size.

Paving block 44 shown in FIG. 3 likewise comprises only four paving elements 45 to 58, namely one element 45 (small diameter), one element 46 (large diameter) and two adjacent elements 47 and 48 (medium diameter).

Concave cylinder generatrix 54 joins one side of rectangular surface 63 with an obtuse angle 65, while the other side of rectangular surface 63 goes smoothly over into convex cylinder generatrix 53. Concave cylinder generatrices 59 and 58 respectively join the other rectangular surface 64, with obtuse angles 66 and 67.

While I have shown and described only several embodiments in accordance with the present invention, it is understood that the same is not limited thereto but is susceptible of numerous changes and modifications as would be known to those skilled in the art, given the present disclosure, I therefore do not wish to be limited to the details shown and described herein but intend to cover all such changes and modifications as are encompassed by the scope of the appended claims.

I claim:

1. A polygonal paving block having a base, side walls and an upper surface, said upper surface comprising at least four projecting elements, the side walls of said block presenting convex and concave curvilinear generatrices which are disposed substantially entirely in respective parallel planes of the side walls of said block, at least a part of the side walls of the block also forming at least one flat surface lying in a plane parallel to said respective parallel planes of said curvilinear generatrices.

2. The projecting block according to claim 1, wherein said paving elements are circular-cylindrical in shape.

3. The paving block according to claim 1, wherein said generatrices are convex and concave cylinder generatrices.

4. The paving block according to claim 3, wherein said at least one flat surface is rectangular in shape and said projecting elements are circular-cylindrical in shape.

5. The paving block according to claim 4, wherein concave cylinder generatrices join with both sides of a flat rectangular surface of the side walls at obtuse angles.

6. The paving block according to claim 4, wherein said at least one flat surface includes small rectangular surfaces which join with both sides of a relatively larger, flat rectangular surface of the side walls at obtuse angles, each of said small rectangular surfaces, in turn, joining one of the concave or convex cylinder generatrices.

7. The paving block according to claim 4, wherein the paving block is formed of concrete.

8. The paving block according to claim 4, wherein the plane of said at least one flat surface is parallel to the axes of said projecting elements.

9. The paving block according to claim 1 comprising at least four projecting elements of equal height.

10. The paving block according to claim 1, wherein said convex and concave curvilinear generatrices are of different radii.

* * * * *